US007645020B2

(12) United States Patent
Mattern

(10) Patent No.: US 7,645,020 B2
(45) Date of Patent: Jan. 12, 2010

(54) HIGH SPEED SERIAL PRINTING USING PRINTHEADS

(75) Inventor: James M. Mattern, Bethany, CT (US)

(73) Assignee: NEOPOST Technologies, Bagneux (FR)

( * ) Notice: Subject to any disclaimer, the term of this patent is extended or adjusted under 35 U.S.C. 154(b) by 47 days.

(21) Appl. No.: 11/045,216

(22) Filed: Jan. 28, 2005

(65) Prior Publication Data

US 2006/0023048 A1 Feb. 2, 2006

Related U.S. Application Data

(60) Provisional application No. 60/591,471, filed on Jul. 27, 2004.

(51) Int. Cl.

| | |
|---|---|
| ***B41J 2/21*** | (2006.01) |
| ***B41J 2/01*** | (2006.01) |
| ***B41J 2/165*** | (2006.01) |
| ***B41J 2/15*** | (2006.01) |

(52) U.S. Cl. ..... 347/22; 347/40; 347/43; 347/20; 400/76; 400/149

(58) Field of Classification Search ..... None
See application file for complete search history.

(56) References Cited

U.S. PATENT DOCUMENTS

| | | | | |
|---|---|---|---|---|
| 4,401,991 | A | 8/1983 | Martin | |
| 5,243,908 | A | 9/1993 | Gilham | |
| 5,293,465 | A | 3/1994 | Abumehdi et al. | |
| 5,526,271 | A | 6/1996 | Abumehdi | |
| 5,683,190 | A | 11/1997 | Gawler | |
| 5,688,729 | A | 11/1997 | Andersson et al. | |
| 5,730,049 | A * | 3/1998 | Broschart | 101/91 |
| 5,838,343 | A | 11/1998 | Chapin et al. | |
| 5,899,615 | A * | 5/1999 | Sansone | 400/188 |
| 6,607,095 | B2 | 8/2003 | Bernard et al. | |
| 6,767,073 | B2 * | 7/2004 | Tschida | 347/13 |
| 2002/0040354 | A1 | 4/2002 | Deshayes et al. | |
| 2002/0080210 | A1 | 6/2002 | Verhoest et al. | |
| 2003/0128250 | A1 * | 7/2003 | Booth | 347/22 |
| 2003/0137550 | A1 | 7/2003 | Baiges | |
| 2003/0222939 | A1 * | 12/2003 | Gompertz | 347/43 |

FOREIGN PATENT DOCUMENTS

| | | | |
|---|---|---|---|
| DE | 37 30 844 | A1 | 3/1989 |
| EP | 0 571 804 | A2 | 12/1993 |
| GB | 2 373 217 | A | 9/2002 |
| JP | 01310965 | A * | 12/1989 |
| JP | 2003320675 | A * | 11/2003 |
| JP | 2004188763 | A * | 7/2004 |
| WO | WO 02/40278 | A1 | 5/2002 |

* cited by examiner

*Primary Examiner*—Daniel J Colilla
(74) *Attorney, Agent, or Firm*—Sughrue Mion, PLLC

(57) ABSTRACT

A printing device adapted to print upon a printing media. The printing device has a printing media inserter, a media path, and a plurality of printheads, positioned serially in the media path. Each of the printheads is adapted to print upon the printing media moving along the media path. The printing media inserter transfers the printing media to a printing media buffer or into the media path. A piece of the printing media traveling along the media path is sequentially printed upon by each of the printheads. The plurality of printheads are controlled to combine print from the plurality of printheads on the piece of printing media and form a resultant combined print image with a resolution different than at least one print of at least one of the plurality of printheads on the piece of printing media.

19 Claims, 3 Drawing Sheets

HIGH SPEED SERIAL PRINTING USING PRINTHEADS

This application claims the benefit of U.S. Provisional Application No. 60/591,471 filed Jul. 27, 2004, which is incorporated by reference herein in its entirety.

BACKGROUND OF THE INVENTION

The exemplary embodiments described herein relate to a method and apparatus for high speed printing using multiple printheads.

BRIEF DESCRIPTION OF RELATED DEVELOPMENTS

Mailing machines enable users to frank one or more mail items by printing a stamp representing the amount paid by the sender. For example, U.S. Pat. Nos. 5,243,908; 5,683,190; 5,526,271; 6,607,095; 6,050,054; 5,293,465; 5,688,729; all of which are incorporated herein by reference in their entirety; disclose franking machines which may comprise franking heads, feeders, folders and user interfaces as examples.

Barcoded indicia generally occupies about 1 square inch, may require 2 pens and 1 printhead to print, and may require a resolution of approximately 300 dots per inch (DPI). Alignment among multiple devices such as pens and printheads can be difficult to achieve and maintain.

Furthermore, the printing devices themselves print at a rate much slower than typical media transport speeds. For example, a typical printhead may be capable of printing 300 DPI on media travelling at a maximum of 55 inches/second. Using envelopes as an example, this translates to approximately 15 thousand envelopes/hour. Typical media transport devices are capable of moving media at much faster speeds.

It would be advantageous to create a system that is capable of printing at speeds faster than presently available.

SUMMARY OF THE EXEMPLARY EMBODIMENTS

In accordance with one exemplary embodiment, a printing device is provided and adapted to print upon a printing media. The printing device has a printing media inserter; a media path; and a plurality of printheads, positioned serially in the media path. Each of the printheads are adapted to print upon the printing media moving along the media path. The printing media inserter transfers the printing media to a printing media buffer or into the media path. A piece of the printing media traveling along the media path is sequentially printed upon by each of the printheads. The plurality of printheads are controlled to combine print from the plurality of printheads on the piece of printing media and form a resultant combined print image with a resolution different than at least one print of at least one of the plurality of printheads on the piece of printing media.

In accordance with another exemplary embodiment, a printing device is provided adapted to print upon a printing media. The printing device has a printing media inserter; a media feeder adapted to feed a piece of the printing media along a media path in a media feed direction at a media feed speed; and a plurality of printheads, each having a predetermined print resolution at a predetermined media feed speed. The printing media inserter transfers the piece of printing media to a printing media buffer or into the media path. Each print head prints on the piece of printing media traveling along the media path in the media feed direction at the media feed speed to enable a printed media feed speed to exceed the predetermined media feed speed for an image produced by the printheads on the piece of printing media of a print resolution no less than the predetermined print resolution.

In accordance with yet another exemplary embodiment, a printing device is provided adapted to print upon a printing media. The printing device has a printing media inserter; a media feeder adapted to feed a piece of the printing media along a media path in a media feed direction at a media feed speed; and a plurality of printheads, each having a predetermined print resolution at the media feed speed. The printing media inserter transfers the printing media to a printing media buffer or into the media path. Each print head prints at the predetermined print resolution on the piece of printing media traveling along the media path in the media feed direction at the media feed speed. A printed image printed by print heads on the piece of printing media has a higher print resolution than the predetermined print resolution.

In accordance with a further exemplary embodiment, a printing device is adapted to print upon a printing media, and the printing device includes a printing media inserter, a media path, and a pair of printheads positioned in the media path, each of the printheads being adapted to print upon the printing media moving along the media path. The printing media inserter transfers the printing media into the media path, and a piece of the printing media traveling along the media path is printed upon by one of the printheads. The pair of printheads is controlled to alternately print and to be cleaned where while one printhead is being cleaned, the other printhead prints upon the media.

BRIEF DESCRIPTION OF THE DRAWINGS

The foregoing aspects and other features of the present invention are explained in the following description, taken in connection with the accompanying drawings, wherein.

DETAILED DESCRIPTION OF THE EXEMPLARY EMBODIMENTS

Figure 1:
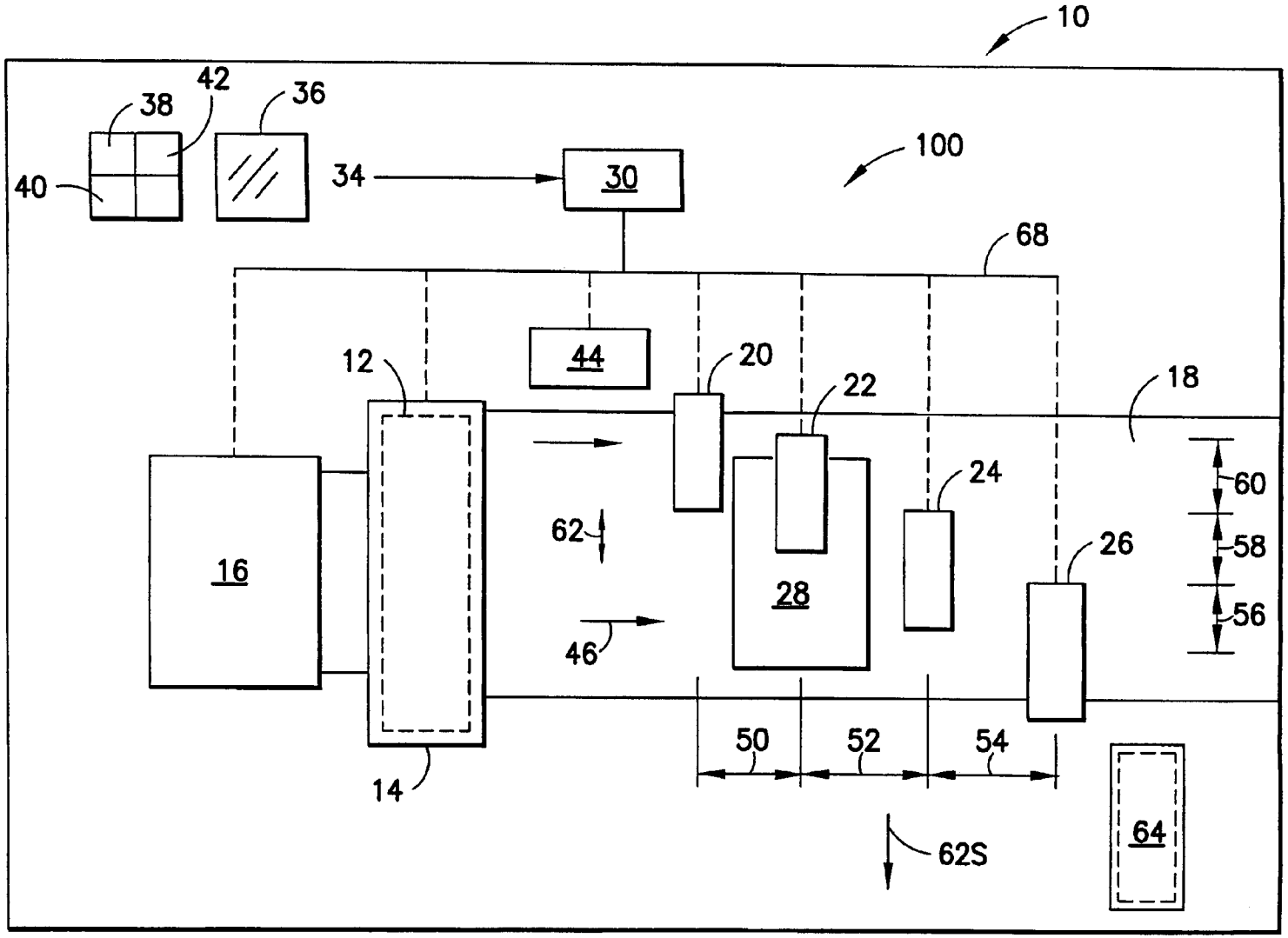
FIG. 1 shows a block diagram of one exemplary embodiment incorporating features of the present invention.

Referring to FIG. 1, there is shown, a schematic block diagram of a printer or mailing machine 10 having a printing device system 100 suitable for practicing the invention disclosed herein and incorporating features in accordance with one exemplary embodiment of the present invention. Although the present invention will be described with reference to the exemplary embodiments shown in the drawings, it should be understood that the present invention can be embodied in many alternate forms of embodiments. In addition, any suitable size, shape or type of elements or materials could be used.

In the exemplary embodiment shown, device 10 may comprise a franking machine having printing device 100. The printing media 12 may for example comprise mail items and the printheads 20-26 may be controlled to print a postage mark 32 or other indicia on the mail items. Alternately, device 10 may comprise a printer or copier and media 12 may comprise paper. In alternate embodiments, any other suitable printing application may be provided. In general, printing device 100 prints upon pieces of printing media 12.

The printing device or system 100 has a printing media buffer 14, a printing media inserter 16, a media path 18, and a plurality of printheads 20, 22, 24, 26 positioned serially in the media path 18. Four printheads are shown in FIG. 1 for example purposes though any suitable number may be used. In the exemplary embodiment, the printheads 20-26 are staggered in a direction at an angle to the media path. Serial distances 50, 52, 54 corresponding to the printhead centerline may be at a common pitch or at different pitches and may overlap or coincide with each other. Similarly, stagger distances 56, 58, 60 corresponding to the printhead centerline may be at a common pitch or at different pitches and may overlap or coincide with each other such that the print ranges of each printhead may overlap wholly, partially or not at all. Printheads 20-26 may be movable substantially parallel to the feed direction indicated by arrow 46 or another direction (indicated by arrow 62) angled relative to the feed direction. Movement of the printheads may be under control of processor 30. The printheads may be part of a meter. Printheads 20-26 may be inkjet printheads or any suitable print head or suitable printing marker. In alternate embodiments, more or less printheads may be provided either stationary or movable. The printing media inserter 16 allows introduction of printing media into device 100. The inserter 16 may transfer the printing media 12 from the printing media buffer 14 into the media path 18 or to the printing media buffer 14. A media feeder 44 feeds the printing media along the media path 18 in a media feed direction 46 at a media feed speed. The media feed speed may be fixed or variable and may be controlled by processor 30. A piece 28 of the printing media 12 traveling along the media path 18 is sequentially printed upon by each of or more than one of the plurality of printheads 20-26. An individual piece of media, for example, an envelope, may be printed upon by each printhead that is enabled to print. As noted before, one or more of the printheads may be movable within the media path. Also, in this embodiment, one or more of the printheads 20-26 may be movable outside the media path (in the direction indicated by arrow 62S) such as for servicing. A printhead service station 64 may be provided for this purpose as further described below.

The buffer 14, the printing media inserter 16, and the plurality of printheads 20-26 are controlled from processor and memory 30 for optimum printing media throughput. Processor 30 may direct or apportion data 34 to print heads 20-26 where print heads 20-26 may share data 34 representing a predetermined image 36. Different information may be printed on each media piece or envelope. Alternately, processor 30 may direct or apportion data 38 to print heads 20-26 where print heads 20-26 may share data 38 representing multiple images 40, 42 to be printed upon an individual piece of print media or separately directed to separate pieces of print media. Alternately, image(s) data may be processed and directed generally to print head(s) to be placed on piece(s) of media in any suitable combination. In this manner, printing information may be dynamically allocated among the printheads according to various parameters, for example, printhead capability, colors in a printhead, printhead resolution, media piece position, media type, media speed, or any other suitable parameter, in order to achieve optimum throughput. The speed of the inserter, buffer, and media path may be controlled in conjunction with the information sent to each printhead in order to achieve optimum throughput. The media path may travel at a variable speed or at a constant speed. The inserter, buffer, media path, and printheads may communicate with each other over a communication path 68, and may be operated by a controller or processor 30 under the control of one or more programs.

Each of printheads 20-26 may have a desired print resolution at a desired media feed speed or desired print resolution capability at the media feed speed of the media feeder. The print resolution of one or more printheads may be fixed or may be adjustable. A piece of the printing media 28 traveling along the media path 18 in the media feed direction 46 at the desired media speed may be printed upon by more than one of the plurality of printheads 20-26 to generate image 36 on the piece. In the exemplary embodiment, the print heads 20-26 printing on the piece are controlled by processor 30 to enable a higher media feed speed than the predetermined media feed speed supported by any printhead capable operating at a predetermined print resolution, and produce an image on the printing media 28 of a resolution greater than the predetermined print resolution of any printhead. As the piece of printing media travels along the media path, images from separate print heads printing on the piece may be interlaced to produce image 36. Thus, for example, the predetermined resolution of the combined printing may be the same as or higher than the maximum print resolution of any one of the printheads. As a further illustration, the media feed speed moving piece 38 may be substantially equivalent to the cumulative maximum or desired printing speed of the number of active printheads printing on the piece 28. Here the media speed may be the sum of the operating media feed speed for each of the print heads where the images may also be interlaced. As a further illustration, the higher print resolution may be the product of the maximum or desired print resolution and the number of print heads desired to make the predetermined image of predetermined resolution. In this manner, the plurality of print heads are controlled at the media feed speed to enable a higher print resolution than a given operating print resolution for a given print head. Each of the printheads may be capable of printing a single color or a combination of colors.

All of the printheads may be capable of printing the same color or combination of colors. Alternately, printheads 20-26 may print different colors or be provided in combinations of groups with the same or different color(s) . For example, the printheads may all be monochrome or black. Alternately, the printheads may all be combination color and black. Colors, for example may be Cyan, Yellow and Magenta or Multiple Cyan, Multiple Yellow and Multiple Magenta or RGB or individual or multiple colors. Alternately, printheads of the same or varying colors may be combined in any suitable combination.

In the exemplary embodiment, processor 30 may control printheads 20-26 to allow at least one of the printheads to be inactivated for servicing, such as to clean or to be replaced while the remaining printheads are active. In this embodiment, processor 30 may account for any servicing of printheads that may be desired and may reduce speed, throughput or output by a marginal fraction. As noted before, the print head may be moved to a different position 28 for servicing or may be serviced in place via an access (not shown). Cleaning, for example, may involve wiping the print face at a wiping station 28 or at the location where the print head is mounted. Processor 30 may control the media throughput where the media throughput is selectively reduced or remains constant depending on the availability of the remaining active printheads. Each of the printheads may then be controlled to be sequentially cleaned or serviced either randomly or with a predetermined sequence, such as every 500 print cycles for example.

As an illustration, three of the four print heads may be active spraying ink at 100 DPI (~3.5M/S) where the dots are interlaced to form a 300 DPI combined print image 36 on piece 28, such as a data matrix barcode with the fourth print head being cleaned. For example every 500 prints a head may be inactive to wipe and the inactive wiped head becomes active. In this embodiment, each head, for example, sprays 100 DPI; the 300 DPI data matrix is split between 3 print heads. In alternate embodiments, the printheads may be cleaned or serviced in parallel or in serial and parallel combinations or other combinations. As a further illustration, each printhead may print at a reduced resolution. For example, a printhead with an unreduced print resolution of 300 DPI may be operated to print at 150 DPI, with a corresponding increase in print speed and desired media feed speed. Throughput may be increased even further by sharing information among printheads such that each printhead prints at, for example, 150 DPI, but the effective resolution of the finally printed media piece is 300 DPI where the printed images are interlaced. For example, if a single printhead 20-26 is capable of printing 15K pieces/HR@300 DPI, then the combined effect of 4 printheads may print 60K pieces/HR@300 DPI. To illustrate this, 4 envelopes with gap measure approximately 42" in length and total throughput would be: 60,000/(1 set of envelopes+1 set of gap)=30,000 effective throughput.

Figure 2:
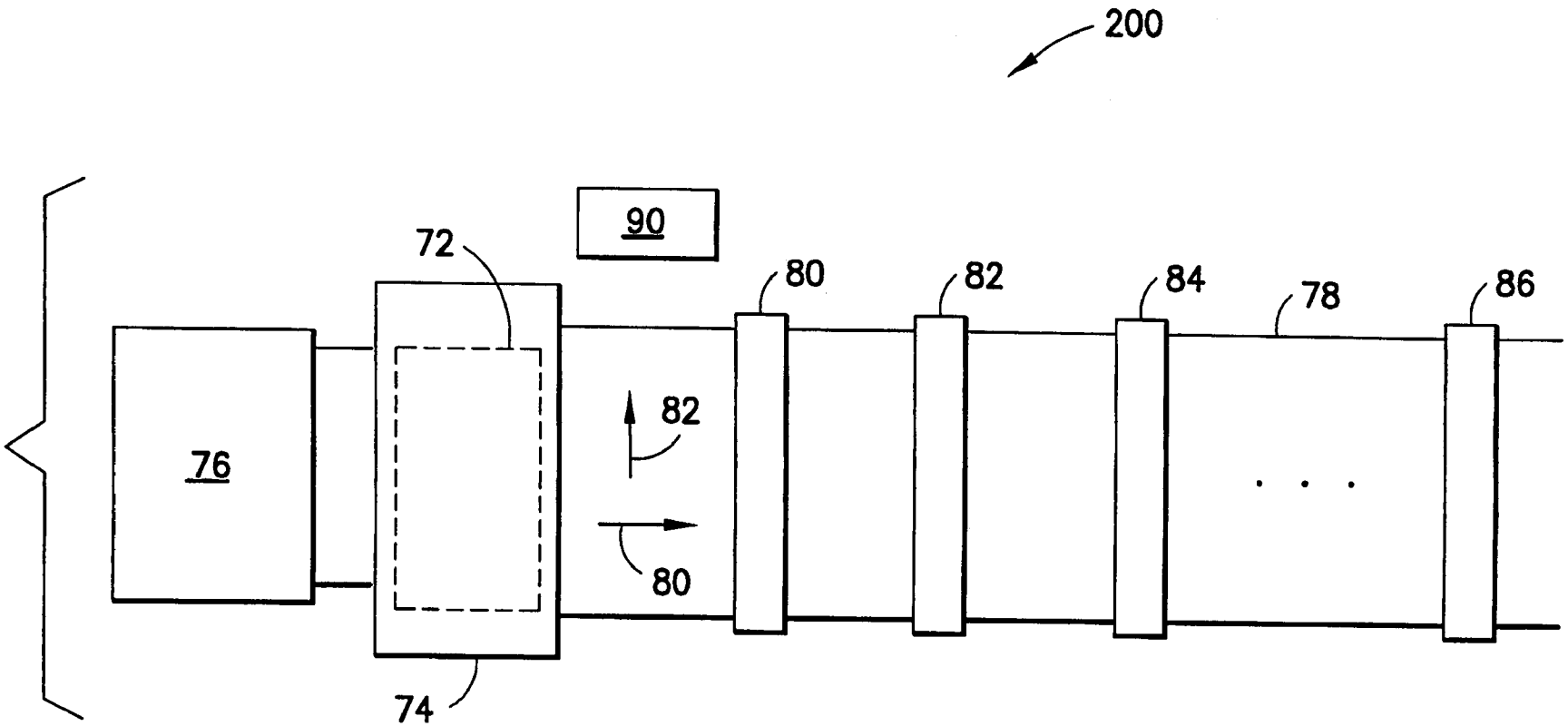
FIG. 2 shows a block diagram of another exemplary embodiment.

FIG. 2 shows another embodiment 200 where the printheads each span the media path and are not staggered. The printing device or system 200 has a printing media buffer 74, a printing media inserter 76, a media path 78, and a plurality of printheads 80, 82, 84, 86 positioned serially in the media path 18 and not staggered along the media path. The serial distances corresponding to the printhead centerline may be at a common pitch or at different pitches and may overlap or coincide with each other. Here, the printheads are not staggered and print the full width of the path 78. Printheads 80-86 may be movable in the feed direction 80 or perpendicular to the feed direction 82 either under control of a processor or otherwise or in alternate directions. In alternate embodiments, more or less printheads may be provided either stationary or movable. The printing media inserter 76 transfers the printing media 72 from the printing media buffer 74 into the media path 78 or to the printing media buffer 14. A media feeder 90 feeds the printing media along the media path 78 in a media feed direction 80 at a media feed speed. As in the embodiment of FIG. 1, an individual piece of media may be printed upon by each printhead that is enabled.

Figure 3:
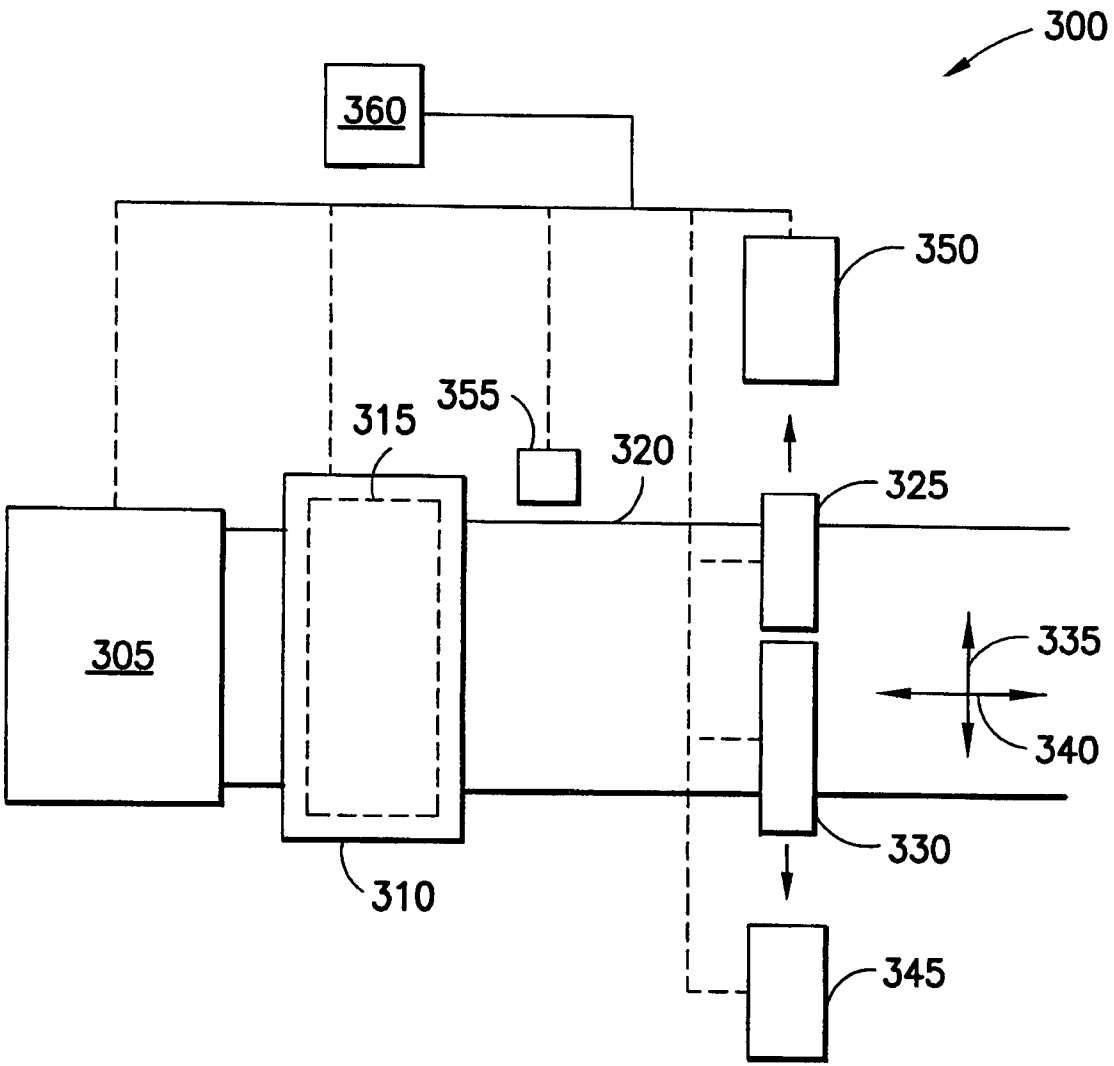
FIG. 3 shows a block diagram of a further exemplary embodiment.

FIG. 3 shows yet another embodiment 300 with two printheads 325, 330. The printing device or system 300 is generally controlled by a processor 360 and has a printing media inserter 305, a printing media buffer 310, and a media path 320. The printheads 325, 330 are shown positioned laterally across the media path 320 but may also be staggered along the media path 320. In this embodiment, each printhead is capable of printing across the full width of the media path 320. Printheads 325, 330 may be movable in the feed direction 340 or perpendicular to the feed direction 335 generally under control of the processor 360.

In alternate embodiments, more or less printheads may be provided and may be either stationary or movable. The printing media inserter 305 transfers the printing media 315 from the printing media buffer 310 into the media path 320. A media feeder 355 feeds the printing media 315 along the media path 320 in a media feed direction 340 at a media feed speed.

In this embodiment an individual piece of media may be printed upon by a single printhead. The printheads 325, 330 generally alternate printing and while one printhead is printing the other printhead travels to a printhead cleaning station 345 for cleaning operations. As mentioned above, cleaning may include, for example, wiping a print face of the printhead. Cleaning may also include spitting or otherwise ejecting an amount of ink, applying a substance to the printface, or other operations associated with removing excess or dried ink and generally cleaning the printface of the printhead. Each printhead may travel to printhead cleaning station 345 for cleaning operations, or as shown in the example of FIG. 3, printhead 325 may travel to printhead cleaning station 350 while printhead 330 may travel to printhead cleaning station 345.

Processor 360 generally controls the media throughput at a constant or variable rate and also controls the operations of the printheads 325, 330, and the cleaning stations 345, 350.

This embodiment provides an increase in throughput over a single printhead because little or no printing capacity is lost due to cleaning operations. For example, as mentioned above, a single printhead 325, 330 may be capable of printing 15K pieces/HR at 300 DPI. A printhead may require cleaning after printing approximately 500 pieces, and cleaning may occupy approximately 8 seconds. Thus, a single printhead may print for approximately 120 seconds and then require 8 seconds for cleaning, thus reducing throughput to approximately 14.062K pieces/HR. By introducing a second printhead there is no appreciable loss due to cleaning, and the exemplary speed of 15K pieces/HR may be maintained.

It should be understood that the foregoing description is only illustrative of the invention. Various alternatives and modifications can be devised by those skilled in the art without departing from the invention. One such example is where other configurations of printheads may also be used. Accordingly, the present invention is intended to embrace all such alternatives, modifications and variances which fall within the scope of the appended claims.

What is claimed is:

1. A printing device adapted to print upon a printing media, the printing device comprising:

a printing media inserter;

a media path; and a plurality of printheads positioned serially in the media path, each of the printheads being adapted to print upon the printing media moving along the media path;

wherein the serial distances between each printhead are at different pitches, wherein the printing media inserter transfers the printing media into the media path, wherein a piece of the printing media travelling along the media path is sequentially printed upon by each of the printheads, wherein the printheads are stationary while printing on the printing media, wherein the plurality of printheads are controlled by a controller to combine print therefrom on the printing media and form a resultant combined print image on the printing media having a resolution different from the resolution of at least one of the printheads, wherein the printheads are controlled by a controller to allow at least one of the printheads to be inactivated to be serviced while the remaining printheads remain active, and wherein each of the printheads is controlled by a controller to be sequentially serviced.

2. A franking machine comprising the printing device of claim 1, wherein the printing media comprises mail and wherein the printheads are controlled by a controller to print a postage mark.

3. The printing device of claim 1, wherein the servicing comprises cleaning the printheads.

4. The printing device of claim 1, wherein a media throughput may be selectively reduced or remain constant depending on an availability of active printheads.

5. The printing device of claim 1, wherein the plurality of printheads are controlled by a controller to share data representing the resultant combined image and wherein at least one of the printheads is disposed relative to the printing media so that print from the at least one printhead on the printing media is interlaced with other print from another one of the printheads.

6. The printing device of claim 1, wherein the plurality of printheads is controlled by a controller to share data representing separate images for separate printing media.

7. The printing device of claim 1, wherein each of the plurality of printheads is constructed and arranged to print the same color or combination of colors.

8. The printing device of claim 1, wherein at least one of the printheads is constructed and arranged to print a different color than the remaining of the printheads.

9. The printing device of claim 1, wherein the printheads are movable, when the printheads are not printing on the printing media, in a direction substantially parallel to a feed direction of the printing media, substantially perpendicular to the feed direction of the printing media, or both substantially parallel and perpendicular to a feed direction of the printing media.

10. The printing device of claim 1, wherein the printheads are movable, when the printheads are not printing on the printing media, outside the media path for servicing.

11. The printing device of claim 1, wherein the printheads are serviced in place via an access provided in the printing device.

12. The printing device of claim 1, wherein each of the printheads is controlled by a controller to be sequentially serviced on a predetermined, regular schedule.

13. The printing device of claim 1, wherein the printheads have a print range which is the range at which a printhead can print over the media path, and wherein the printheads are staggered so that the print range of at least one printhead is different from the print range of at least another printhead.

14. The printing device of claim 1, wherein each printhead spans the entire media path.

15. A printing device adapted to print upon a printing media, the printing device comprising:

a printing media inserter;

a media feeder adapted to feed a piece of the printing media along a media path in a media feed direction at a media feed speed; and a plurality of printheads positioned serially in the media path, each printhead having a predetermined print resolution at the media feed speed;

wherein the serial distances between each printhead are at different pitches, wherein the printing media inserter transfers the printing media to a printing media buffer or into the media feeder, and wherein each printhead prints at its predetermined print resolution on the printing media travelling along the media path in the media feed direction at the media feed speed and generating a printed image on the printing media having a print resolution higher than the predetermined print resolution of any one of the printheads, wherein the printheads are stationary while printing on the printing media, wherein the printheads are controlled by a controller to allow at least one of the printheads to be inactivated to be serviced while the remaining printheads remain active, and wherein each of the printheads are controlled by a controller to be sequentially serviced.

16. The printing device of claim 15, wherein each of the plurality of printheads is positioned serially in the media path downstream along the media feed direction one from the other and each is capable of printing the same color or combination of colors.

17. The printing device of claim 15, wherein the printheads are controlled by a controller to share data representing the printed image, and wherein the printheads sequentially prints interlaced images resulting in the printed image on the piece-of print media.

18. The printing device of claim 17, wherein the higher print resolution of the resultant printed image is the product of the predetermined print resolution and the number of printheads required to make the printed image.

19. The printing device of claim 18, wherein each of the printheads is constructed and arranged to print the same color or combination of colors.

* * * * *